US006392512B1

(12) United States Patent
Ferree et al.

(10) Patent No.: US 6,392,512 B1
(45) **Date of Patent: *May 21, 2002**

(54) STATIONARY LINE BUS ASSEMBLY

(75) Inventors: James Edward Ferree, Lawrenceville; Neal B. Reeves, Atlanta; Bernard DiMarco, Lilburn, all of GA (US)

(73) Assignee: Siemens Energy & Automation, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,231

(22) Filed: Nov. 5, 1999

(51) Int. Cl.[7] ..... H01H 75/00
(52) U.S. Cl. ..... 335/16; 218/22; 335/195
(58) Field of Search ..... 335/16, 147, 195, 335/202; 218/22, 30, 34, 14.1; 200/238, 244, 275; 439/810–814

(56) References Cited

U.S. PATENT DOCUMENTS 4,470,027 A * 9/1984 Link et al. ..... 335/16
4,513,267 A * 4/1985 McClellan et al. ..... 335/16
4,654,490 A * 3/1987 Leone et al. ..... 218/22
4,654,491 A * 3/1987 Maier et al. ..... 218/22
4,950,853 A * 8/1990 Crookston ..... 218/22
4,970,481 A * 11/1990 Ferree et al. ..... 335/6
4,975,553 A 12/1990 Oster
5,373,273 A * 12/1994 Guery et al. ..... 335/201
5,448,033 A * 9/1995 Leone et al. ..... 335/196
5,475,193 A 12/1995 Perdoncin ..... 218/34

* cited by examiner

*Primary Examiner*—Lincoln Donovan
(74) *Attorney, Agent, or Firm*—Foley & Lardner

(57) ABSTRACT

A circuit breaker (10) including a stationary line bus assembly (47). The stationary line bus assembly (47)comprises a bus body (124) supported by support legs (132) with the bus body (124) having a first longitudinal end portion (125) and a second longitudinal end portion (126), with each end portion terminating at a common end portion (127). The second end portion (126) includes a stationary contact bus (46) in a spaced relationship from the first end portion (125). A line terminal (18) is mounted on the first longitudinal end portion (125) and a contact (44) is attached to the second longitudinal end portion (126). In one embodiment, a bus support (130) is attached to the bus body (124) in the space between the first end portion (125) and the second end portion (126) and separated from the support legs (132) of the bus body (124) by an insulating barrier (134). The stationary bus support (130) can have several configuration.

6 Claims, 8 Drawing Sheets

STATIONARY LINE BUS ASSEMBLY

FIELD OF THE INVENTION

The present invention relates generally to the field of circuit breakers, and more particularly to a molded case circuit breaker stationary line bus assembly.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 400 amps. To carry such current and the magnitudes of short circuit currents that such breakers will experience, the line terminal and stationary contact assembly are typically an integrated structure. As current flows from the line terminal through the stationary contact into the movable contact, magnetic forces are generated in the conductors, and in fact, in some instances the magnetic forces are relied upon to assist in separating the movable contact from the stationary contact and forcing the resulting electrical arc into the arc chamber of the circuit breaker. For higher current rated circuit breakers, the cross section of the contact and its corresponding conductors are increased to handle such higher currents.

It is well known to provide supporting structure for the stationary contact and its conductor to resist the magnetic forces experienced by the contact and its conductors. Such structures include a screw and metal combination supporting the stationary line conductor or utilizing a support post formed in the molded housing of the circuit breaker. These devices or techniques may result in loose parts or they do not provide sufficient shielding or assistance with respect to the magnetic forces generated in the line conductor and stationary contact. One solution to deflections experienced by the line conductors is the use of a lip molded into the circuit breaker casing as described in U.S. patent application Ser. No. 08/935,754 filed Sep. 23, 1997 and assigned to the assignee of this application.

However, there remains a need for a stationary line bus assembly that will attenuate adverse repulsive magnetic forces between the line conductors. There is also a need for a stationary line bus assembly that reduces the tendency of the electrical arc generated during contact separation to remain near the contacts as a result of the magnetic field generated by the contact conductors rather than moving into the arc chute. There is a further need to provide structural support for the stationary line bus during the closing operation of the circuit breaker.

SUMMARY OF THE INVENTION

The circuit breaker of the present invention includes the stationary line bus assembly. The stationary line bus assembly comprises a bus body supported by support legs with the bus body having a first longitudinal portion with a first end and a second end and a second longitudinal portion with a first end and a second end, with each second end portions of the first and second longitudinal portions terminating at a common end portion. The second longitudinal portion including a stationary contact bus and in a spaced relationship from the first longitudinal portion, wherein a space is defined between the first and second longitudinal portions. A line terminal is mounted on the first longitudinal portion and a contact is attached to the second longitudinal portion. In one embodiment, a bus support is attached to the bus body in the space between the first longitudinal portion and the second longitudinal portion and separated from the support legs of the bus body by an insulating barrier. The stationary bus support can have several configurations. The circuit breaker also includes a molded case including a main cover with a first terminal mounted in the case and having a stationary line bus assembly as well as a second terminal mounted in the case. A second contact is electrically coupled to the second terminal. An operating mechanism having an ON position, an OFF position and a TRIPPED position is coupled to the second contact. An intermediate latching mechanism is mounted in the housing and coupled to the operating mechanism. A trip unit coupled to the second contact and the second terminal with the trip unit and selective operative contact with the intermediate latching mechanism operates the circuit breaker under a short circuit condition or overload condition.

The present invention includes a method for making a stationary line bus assembly for a molded case circuit breaker.

DETAILED DESCRIPTION OF THE PREFERRED EMBODIMENTS

Figure 1:
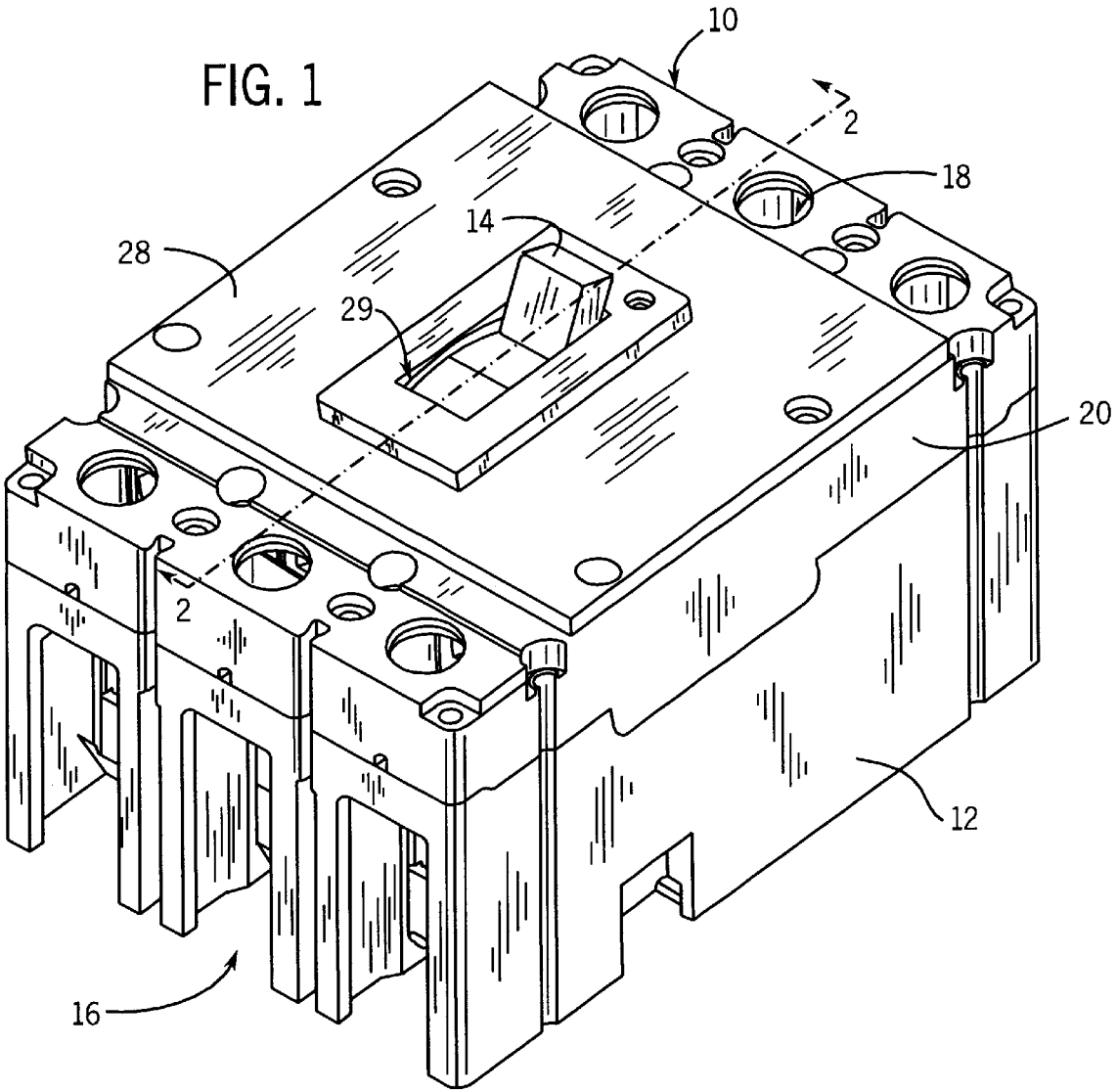
FIG. 1 is an isometric drawing of a molded case circuit breaker which includes an embodiment of the present stationary line bus assembly.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
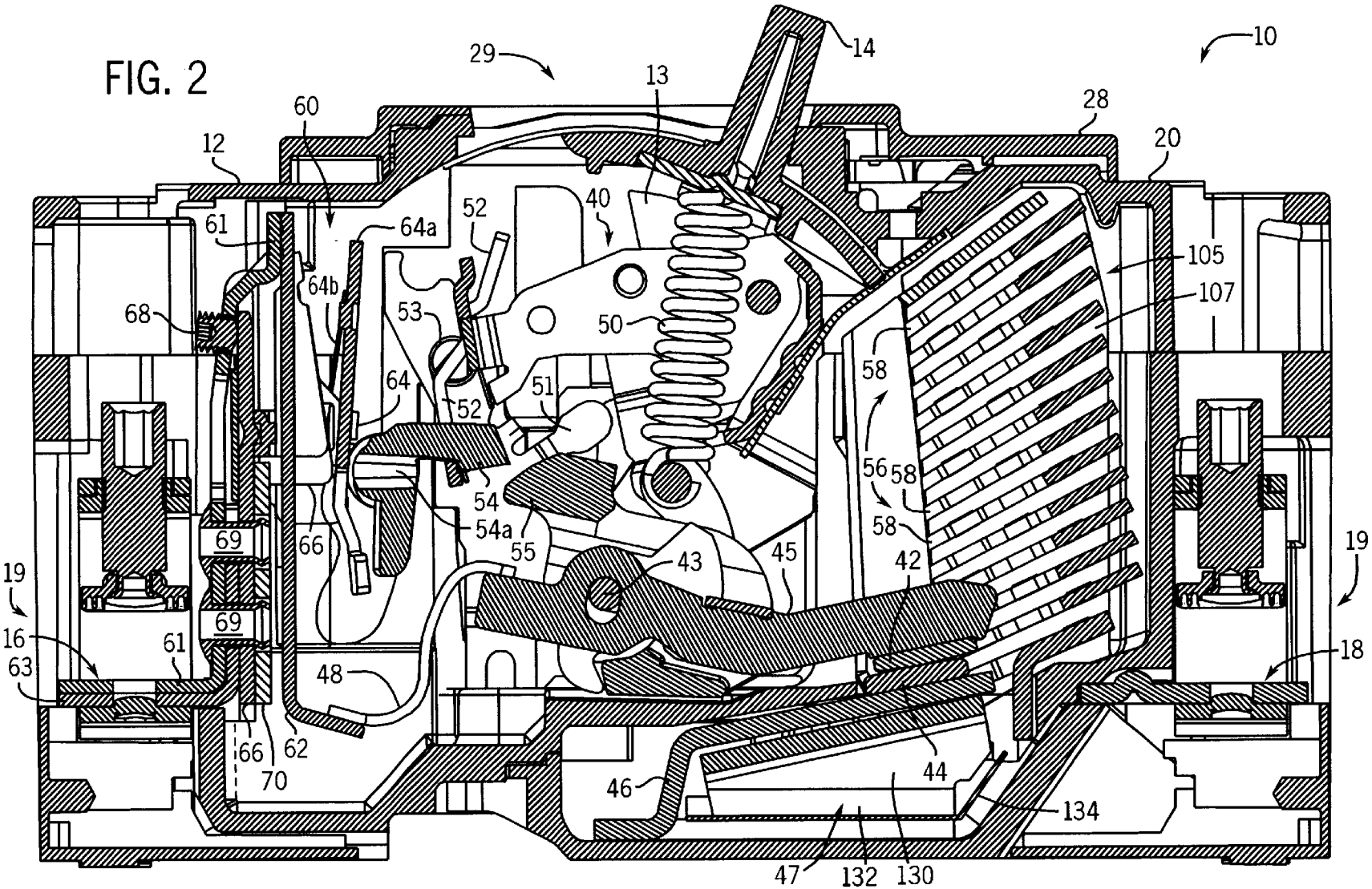
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, sub-base 12a, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bi-metallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bi-metallic element 62 and from the bi-metallic element 62 to the load terminal 16. (See FIG. 3) When the current flowing through the circuit breaker exceeds the rated current for the breaker, it heats the bi-metallic element 62, causing the element 62 to bend towards the trip bar 54. If the over current condition persists, the bi-metallic element 62 bends sufficiently to engage the trip bar surface. As the bi-metallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
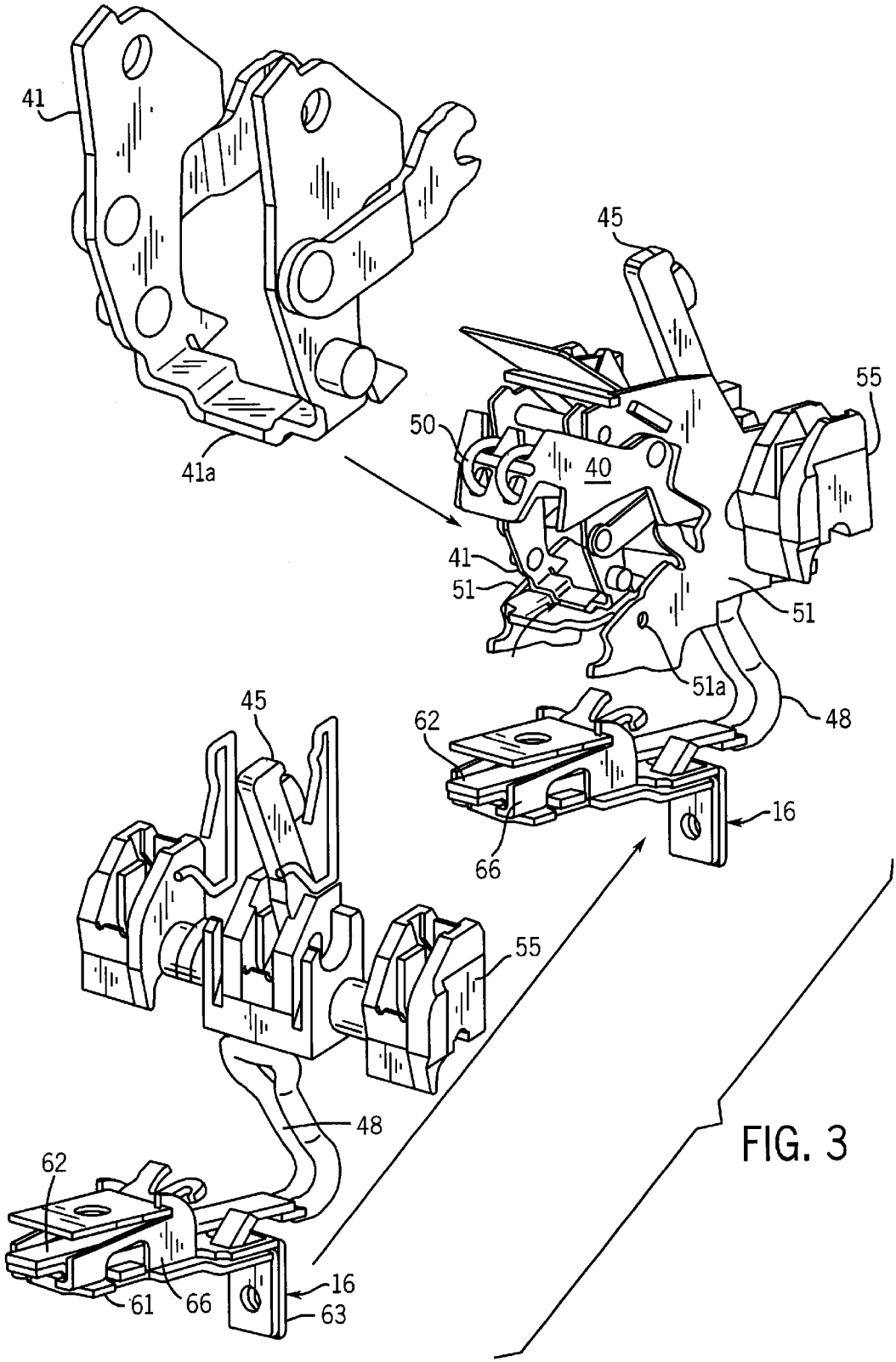
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bi-metallic element 62 by a flexible conductor 48 (e.g. braided copper strand). As shown in FIG. 3, current flows from the flexible conductor 48 through the bi-metallic element 62 to a connection at the top of the bi-metallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
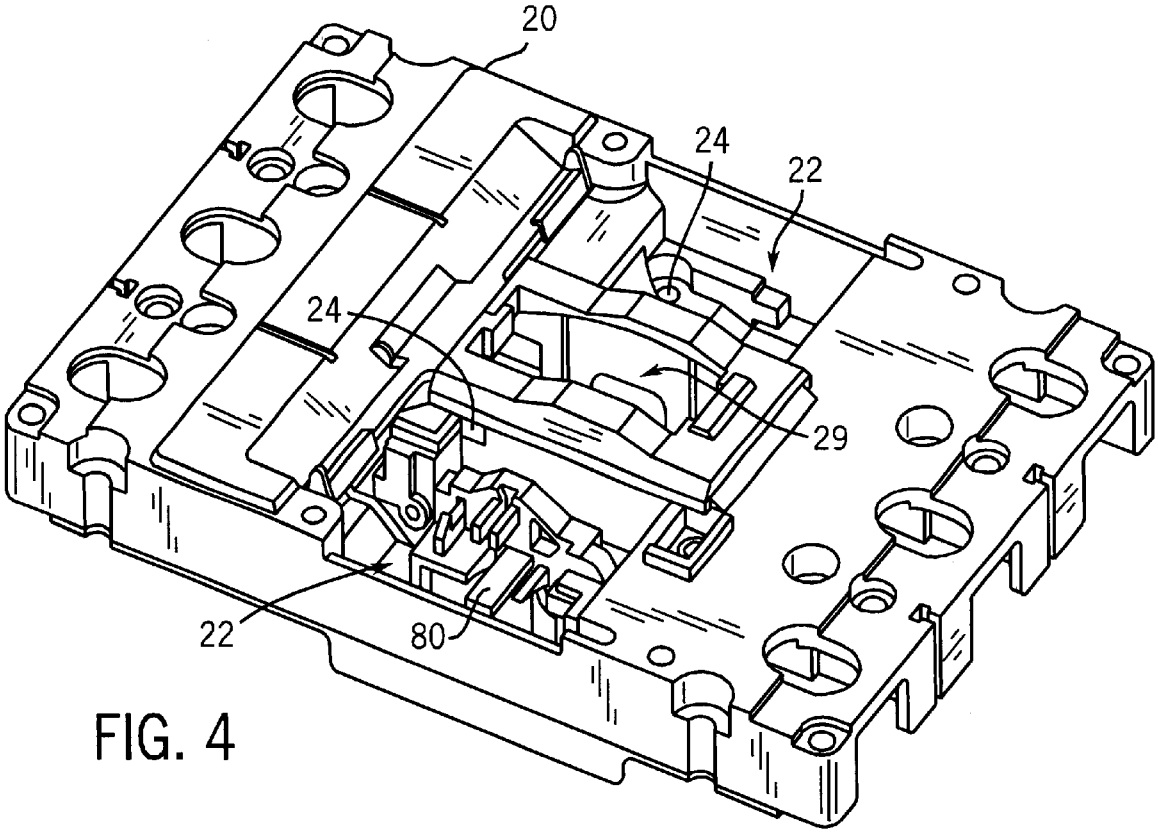
FIG. 4 is an illustration of the main circuit breaker cover for the circuit breaker shown in FIG. 1.

FIG. 4 illustrates the main breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54 in a counter clockwise direction causing release of the mechanism latch 52 of the operating mechanism 40. The shunt trip has a member protruding through one of the openings in the accessory socket 22 and engages the operating mechanism 40. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

The line terminal 18 and the fixed line contact arm 46 are part of a stationary line bus assembly 47 as shown in FIGS. 5, 8, 11, and 12. The several embodiments illustrated function in basically the same manner with the variations described below.

Figure 5:
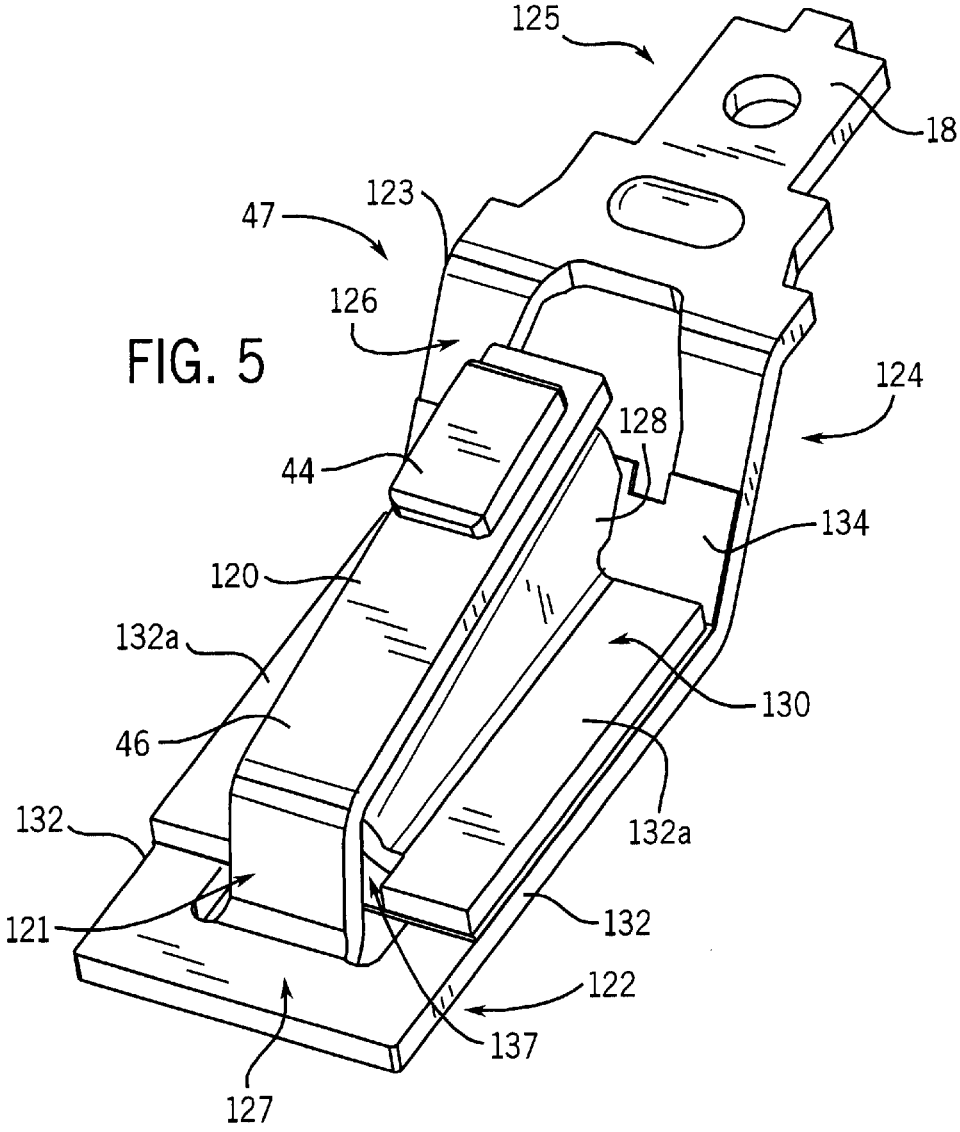
FIG. 5 is a perspective view of a stationary line bus assembly for the line side of the molded case circuit breaker illustrated in FIG. 2.
Figure 6:
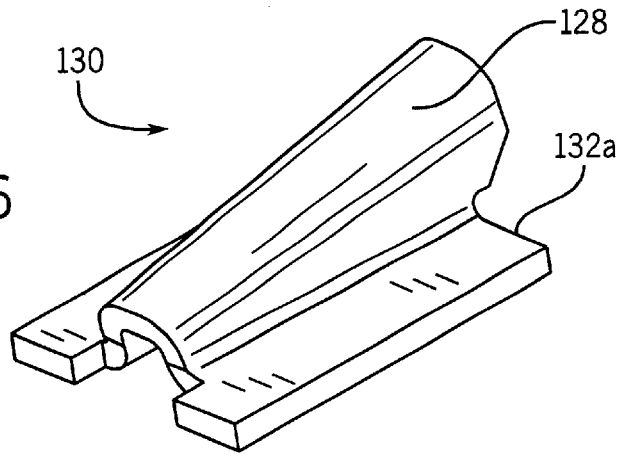
FIG. 6 is a perspective view of an embodiment of a stationary bus support for the stationary line bus of FIG. 5.
Figure 8:
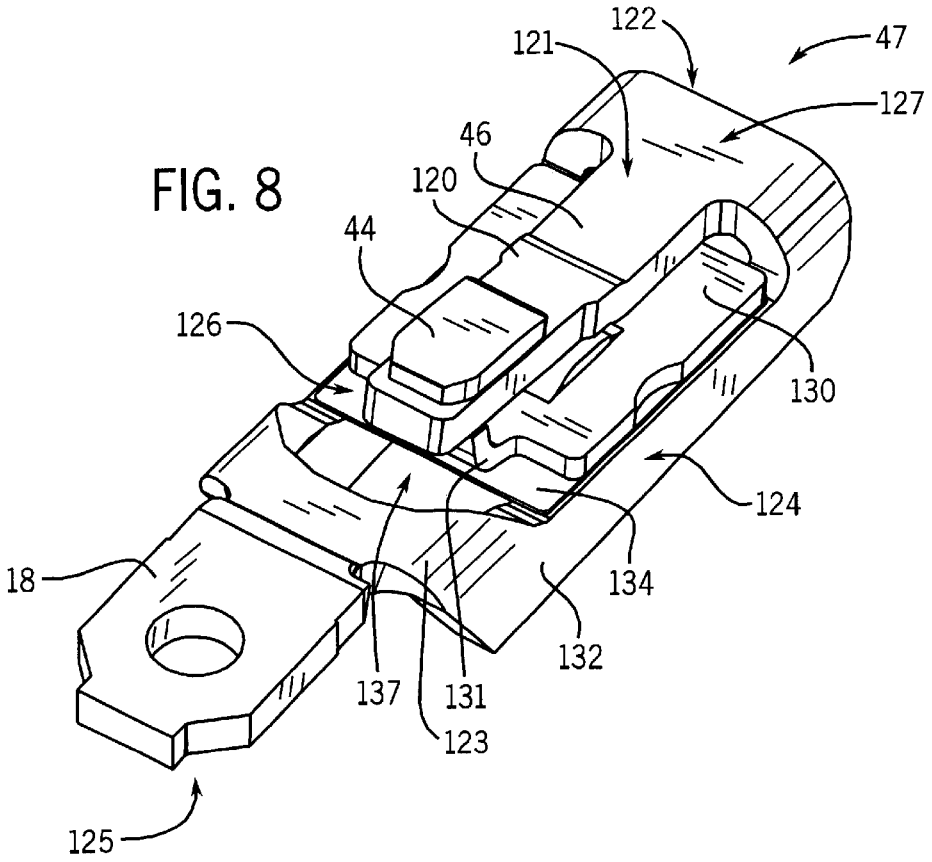
FIG. 8 is a perspective view of the stationary line bus assembly of the circuit breaker illustrated in FIG. 7.
Figure 9:
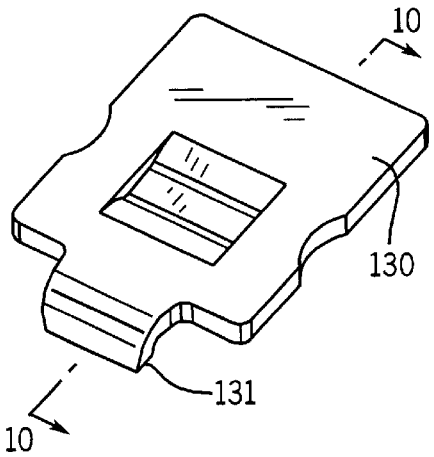
FIG. 9 is a perspective bottom view of an embodiment of a stationary bus support for the stationary line bus assembly of FIG. 8.
Figure 11:
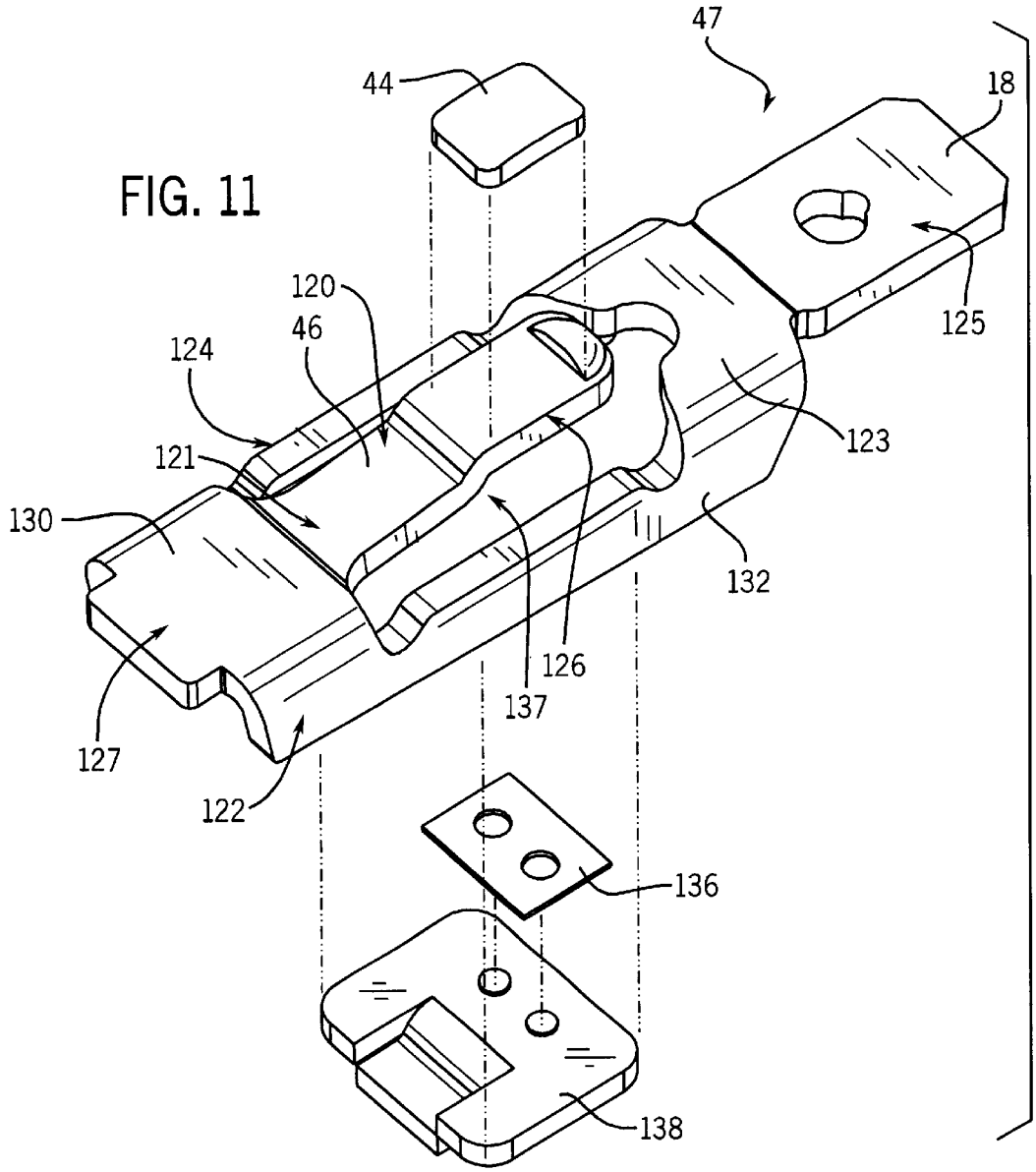
FIG. 11 is an exploded perspective view of another embodiment of a stationary line bus assembly for the line side of a molded case circuit breaker.

The stationary line bus assembly 47 illustrated in FIG. 5 is also illustrated in the sectional view shown in FIG. 2. The stationary line bus assembly 47 for a molded case circuit breaker 10 comprises a bus body 124 supported by support legs 132 with the bus body 124 having a first longitudinal end portion 125 and a second longitudinal end portion 126, with each end portion terminating at a common end portion 127. The bus body 124 can be formed from sheet metal, such as copper or a copper alloy which is cut, by a punch or other well known methods to remove a portion of the sheet metal. The bus body 124, or parts thereof may be provided with a coating, such as silver flash. The second end portion 126 is then manipulated up and away from the first end portion 125 in a spaced relationship as seen in FIGS. 5, 8 and 11. A line terminal 18 is mounted on the first longitudinal end portion 125. In the preferred embodiment, the line terminal and the first end portion 125 are integral as shown in the three exemplary embodiments. A stationary contact 44 is attached to the second longitudinal end portion 126 on the portion of the stationary contact bus 46 away from the common end portion 127 of the stationary line bus assembly 47. The contact 44 can be welded and most preferably brazed to the second end portion 126. A formed stationary bus support 130 having integral support pads 132*a* is attached to the bus body 124 in the space between the first end portion 125 and the second end portion 126. The bus support 130 is formed from a ferro magnetic material, such as steel, and may have a coating such as zinc or chromate. Exemplary embodiments of the stationary bus support 130 are illustrated in FIG. 6, FIG. 9 and FIG. 11. The integral support Pads 132*a* stationary bus support 130 are separated from the support legs 132 of the bus body 124 by an insulating barrier 134. The insulating barrier 134 can be of any suitable electrical insulating material.

The embodiment of the stationary line bus assembly 47 illustrated in FIG. 5 is typically utilized in a circuit breaker rated for approximately 160 amps. of continuous current. The stationary bus support 130 illustrated in FIG. 6 is inserted in the space between the first end portion 125 and the second end portion 126 of the bus body 124 with the width of the stationary bus support 130 being the same as the width of the stationary line bus body 124. The stationary bus support 130 for this embodiment, is a raised partial cylindrical portion 128 formed from the sheet metal member and engages the stationary contact bus 46. The raised cylindrical portion 128 of the stationary bus support 130 approximates the angle of the second end portion 126 with respect to the first end portion 125 so that the second end portion 126 is supported by the support bus 130 over substantially it's entire length. The stationary bus support 130 functions to both support the stationary contact bus 46 of the second longitudinal end portion 126 and to provide a magnetic shield to attenuate the adverse repulsive magnetic forces between the U-shaped line conductor formed by the first longitudinal end portion 125 and the second longitudinal end portion 126 of the bus body 124. In addition, and at the same time, the magnetic shielding function of the stationary bus support 130 also attenuates the adverse attractive magnetic forces between the first longitudinal end portion 125 and the load contact arm 45. Such attractive forces would, in the absence of a magnetic shield, tend to impede the opening movement of the contact arm 45. The stationary bus support 130 also reduces the tendency of the electrical arc formed by the movement of the moveable contact 42 away from the stationary contact 44 to remain near the contacts 42, 44 because of the magnetic force generated by the folded back line conductor. However, the repulsive magnetic force generated between the stationary line bus assembly 47 and the moveable contact arm 45 is not impeded but rather, it is intensified by the stationary bus support 130 so that that magnetic force assists in separating the contacts 42, 44 and moving the resulting electric arc from the contact pads to the arc chute assembly 105 in the arc chamber 56.

Figure 7:
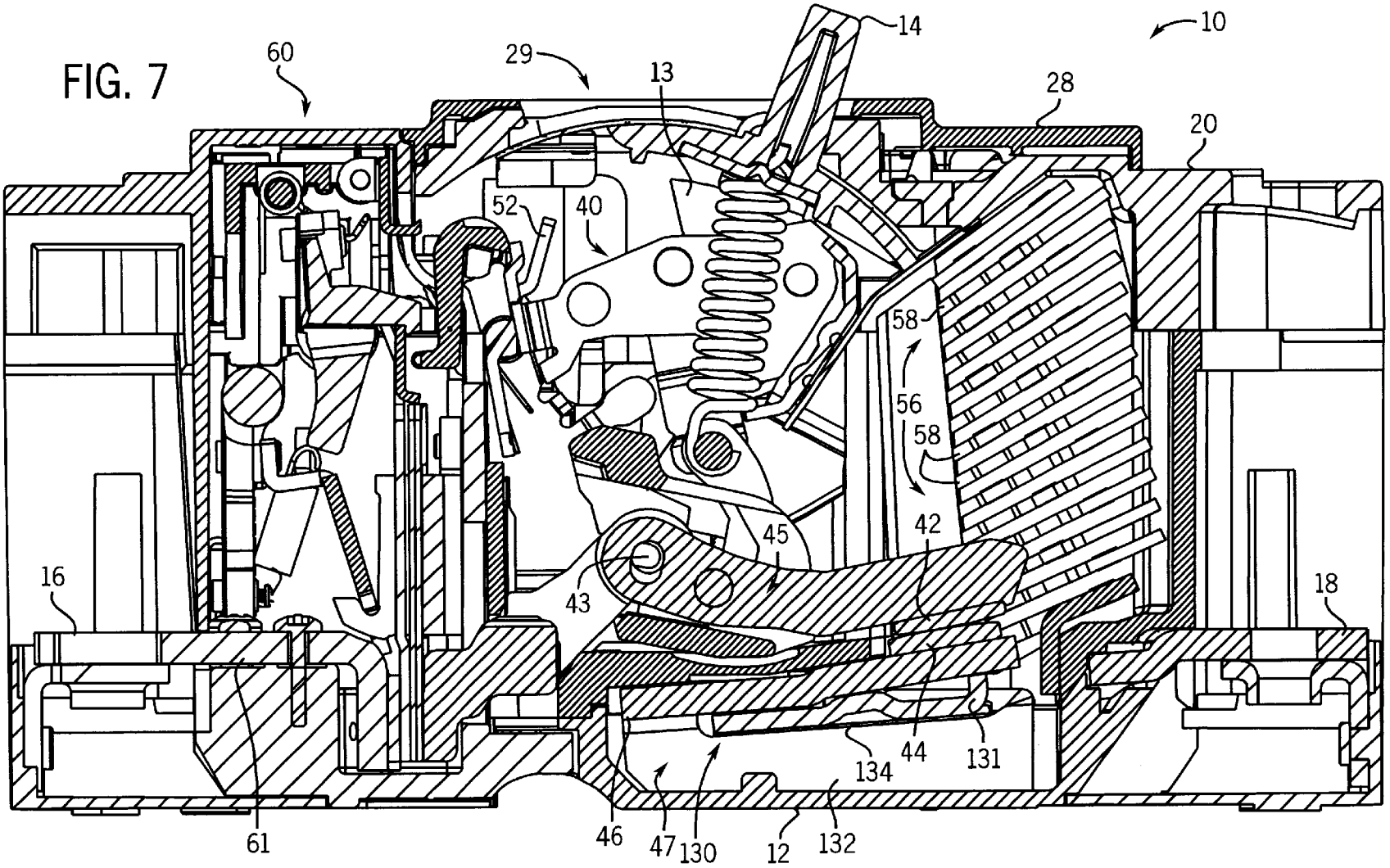
FIG. 7 is a sectional side view of another embodiment of a circuit breaker illustrating another embodiment of a stationary line bus assembly and illustrating a detachable trip unit.
Figure 10:
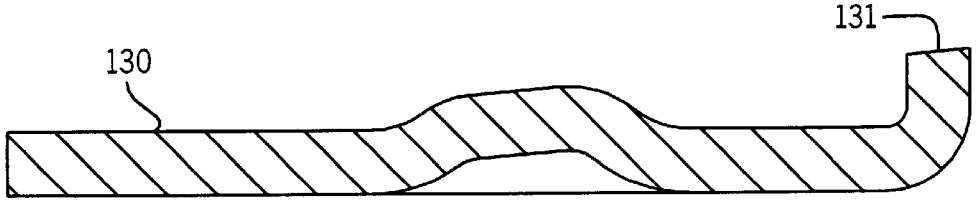
FIG. 10 is a side sectional view of the stationary bus support illustrated in FIG. 9.

FIG. 7 illustrates a sectional side view of another embodiment of a circuit breaker 10 which is rated for approximately 250 amps. of continuous current. Another embodiment of the stationary line bus assembly 47 is illustrated, in sectional view, in that circuit breaker. That embodiment of the present stationary line bus assembly 47 is illustrated in FIG. 8. In this embodiment of the stationary line bus assembly 47 the bus body 124 is also formed from sheet metal, such as copper or a copper alloy, but has a substantially U-shaped cross section. The stationary bus support 130 in this embodiment is illustrated in FIGS. 9 and 10. As is best seen in FIG. 9, the stationary bus support 130 is a substantially flat planar sheet metal member with an upturned support tab 131 formed on one end of the stationary bus support 130. The stationary bus support 130 is attached to the bus body 124 in the space between the first longitudinal end portion 125 and the second longitudinal end portion 126 is shown in FIG. 8. The support tab 131 engages the underside of the second longitudinal end portion 126 to provide the support of the stationary contact bus portion of the second end portion 126. An insulating barrier 134 separates the stationary bus support 130 from the stationary bus support legs 132 of the bus body 124. The line terminal 18 is shown in FIG. 8 as being integrally formed with the first longitudinal end portion 125 of the stationary line bus assembly 47.

Figure 12:
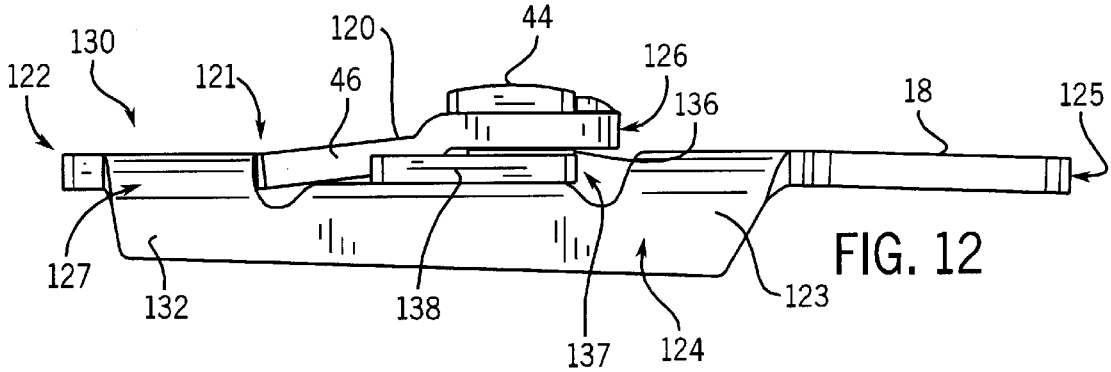
FIG. 12 is a side assembly view of the stationary line bus assembly illustrated in FIG. 11.

FIGS. 11 and 12 illustrate another embodiment of the stationary line bus assembly 47 which is utilized in a circuit breaker rated for approximately 400 amps. of continuous current. In this embodiment, the stationary bus support 138 acts as a magnetic flux intensifier which is mounted in the space between first end portion 125 and the second end portion 126 of the bus body 124 of the stationary line bus assembly 47. In this embodiment, there is an insulator separating the stationary bus support 138 from the second longitudinal end portion 126 of the stationary contact bus 46.

In all three illustrated embodiments of the stationary line bus assembly 47, the stationary bus support 130 constitutes a magnetic shield to attenuate the adverse magnetic forces and as an intensifier for the beneficial magnetic forces generated during operation of the circuit breaker 10. The stationary bus support 130 also provides structural support against the repulsive magnetic forces generated between the moveable contact arm 45 and the stationary contact bus 46 as well as from the physical forces exerted upon the stationary line bus assembly 47 when the circuit breaker 10 is operated to close the contacts.

The stationary line bus assembly 47 is mounted in each pole of the circuit breaker 10 in a chamber formed between the base 12 and the sub-base 12*a* of the circuit breaker 10. Additional restraints to maintain the stationary line bus assembly 47 in proper position can be utilized by such devices as the lips molded to the base 12 as described in previously cited U.S. Ser. No. 08/935,754.

While the embodiments below illustrated in the figures and described above are presently preferred, it should be understood that these embodiments are offered by way of example only. The invention is not intended to be limited to any particular embodiment, but it is intended to extend to various modifications that nevertheless fall within the scope of the intended claims. For example, other types of ferro magnetic material can be utilized for the stationary bus support and different shapes can be utilized for the longitudinal portions as well as the stationary bus supports. It is contemplated that an electronic trip unit can be used. It is also contemplated that the trip mechanism having a bi-metal trip unit or electronic trip unit and a low terminal be housed in a separate housing capable of mechanically and electrically connecting to another housing containing the operating mechanism and the stationary line bus assembly thereby providing for a quick and easy change of current ratings for an application of the circuit breaker contemplated herein. Other modifications will be evident to those with ordinary skill in the art.

What is claimed is:

1. A stationary line bus assembly for a molded case circuit breaker comprising:

a bus body supported by support legs with the bus body having a first longitudinal portion with a first end and a second end and a second longitudinal portion with a first end and a second end, with each second end portion of the first and second longitudinal portions terminating at a common end portion, with the second longitudinal portion including a stationary contact bus and in a spaced relationship from the first longitudinal portion, wherein a space is defined between the first and second longitudinal portions;

a metallic stationary bus support having integral support pads, with the stationary bus support attached to the bus body in the space between the first longitudinal portion and the second longitudinal portion and separated from the support legs of the bus body by an insulating barrier;

a line terminal mounted on the first longitudinal portion; and a contact attached to the second longitudinal portions.

2. The assembly of claim 1, wherein the stationary bus support is a formed sheet metal member having a raised, partial cylindrical portion which engages the stationary contact bus.

3. The assembly of claim 1, wherein the stationary bus support is a sheet metal member having at least a flat portion and having a support tab on one end which engages the stationary contact bus.

4. The assembly of claim 1, wherein the line terminal is integrally formed with the first longitudinal portion.

5. The assembly of claim 1, wherein the bus body has at least a uniform width portion.

6. The assembly of claim 1, including a magnetic flux intensifier mounted to the bus body in the space between the first longitudinal portion and the second longitudinal portion and separated from the second longitudinal portion by an insulator.

* * * * *